US005866985A

United States Patent [19]

Coultas et al.

[11] Patent Number: 5,866,985

[45] Date of Patent: Feb. 2, 1999

[54] STABLE MATCHING NETWORKS FOR PLASMA TOOLS

[75] Inventors: Dennis Keith Coultas, Hopewell Junction; John Howard Keller, Newburgh, both of N.Y.

[73] Assignee: International Business Machines Corporation, Armonk, N.Y.

[21] Appl. No.: 758,791

[22] Filed: Dec. 3, 1996

[51] Int. Cl.[6] ..... H05H 1/24

[52] U.S. Cl. ..... 315/111.21; 333/17.3; 315/111.51

[58] Field of Search ..... 333/17.3, 32; 315/111.21, 315/111.51

[56] References Cited

U.S. PATENT DOCUMENTS

| | | | |
|---|---|---|---|
| 3,616,405 | 10/1971 | Beaudry | 204/192 |
| 4,201,579 | 5/1980 | Robinson et al. | 315/111.21 X |
| 4,843,634 | 6/1989 | Pike | 333/32 X |
| 5,077,499 | 12/1991 | Oku | 315/111.21 |
| 5,079,507 | 1/1992 | Ishida et al. | 333/17.3 X |
| 5,302,882 | 4/1994 | Miller | 315/111.21 |
| 5,325,019 | 6/1994 | Miller et al. | 315/111.21 |
| 5,383,019 | 1/1995 | Farrell et al. | 315/111.51 X |

FOREIGN PATENT DOCUMENTS

| | | | |
|---|---|---|---|
| 5326409 | 12/1993 | Japan | 315/111.21 |

*Primary Examiner*—Steven Mottola
*Assistant Examiner*—Justin P. Bettendorf
*Attorney, Agent, or Firm*—Schmeiser, Olsen & Watts; Alison D. Mortinger

[57] ABSTRACT

Apparatus and method for obtaining stable matching networks for plasma tools for use in the plasma processing industry. In an RF plasma apparatus, running at a matched condition for a transmission line and the plasma tool matching network such that the input impedance at the input to the transmission line is different than that of the output impedance of an RF generator and such that when the plasma density in the plasma tool decreases the input impedance will match the output impedance of the generator.

38 Claims, 11 Drawing Sheets

NORMALIZED (INDUCTIVE PLASMA RESISTANCE)$^{-1}$ FOR AN ELECTROPOSITIVE GAS

NORMALIZED (INDUCTIVE PLASMA RESISTANCE)$^{-1}$ FOR AN ELECTRONEGATIVE GAS

STABLE MATCHING NETWORKS FOR PLASMA TOOLS

BACKGROUND OF THE INVENTION

1. Technical Field

The present invention relates to the field of plasma processing and, more, particularly to the method and system of supplying the energy for use in the plasma apparatus.

2. Background Art

Plasma processing equipment is used extensively in the industry for the modification of materials. These modifications include etching, deposition, and ion implantation for fabrication of microelectronic circuits in semiconductor devices. As technology advances due to competition, industry requires and benefits from improving control over the properties of these plasmas.

A plasma is an unusually high-temperature gas that is so highly ionized it is electrically conductive and susceptible to magnetic fields. A variety of techniques are known for energizing the gas. One commonly used technique is the energizing of the gas using a high-frequency power supply. A common practice is to use high frequency alternating current (AC) fields to energize or excite the gas. Techniques for utilizing radio frequency (RF), as well as microwave fields of higher frequencies are well-known in the art.

In a general plasma apparatus, an electrode is disposed in a reaction chamber and the high-frequency power supply is connected to the electrode through a matching network and a feeding cable. The matching network consists of a variety of interfaces and control circuits. The object of most plasma process tools is to match the impedance of the cable and the plasma chamber electrode so that reflectance loss is avoided and most of the power is sent to the plasma. (This will be referred to as the "normal case.") Reflectance loss is the loss caused by the reflection of an electromagnetic field at a discontinuity in a transmission line. A nonuniform filter will transmit a wave undisturbed provided that the iterative impedance of each filter section is made equal. If the iterative impedances of the sections are different, loss of power output occurs due to reflections of the wave occurring at the junctions. As previously stated, in most systems the process engineer's goal is to match the impedances of the sections of a system to ensure optimum conditions for transfer of power from one part of the system to another. Reflections of wave power in a transmission line are eliminated by making the plasma load impedance equal to the generator output impedance, and the line impedance of the transmission line equal to both of the above impedances.

Another reason process engineers do not like mismatches in the impedances between the sections is that it means that the process engineer is not able to tell the difference between the reflected power due to mismatches from the reflected power which indicates a problem in the tool. The only difference is that the reflected power indicating a tool problem would have a different phase. Therefore, the goal of most process engineers is to try and obtain the closest matching possible in the network.

A paper by Masaki Shinomiya, "The Matching Network of the Inductively Coupled Discharge Lamps", *J. Light & Vis. Env.,* Vol. 19, No. 2 (1995), p. 33, and hereby incorporated by reference, shows how to design a stable matching network for a voltage source.

SUMMARY OF THE INVENTION

In accordance with the present invention, there is provided a plasma apparatus comprising a generator with a generator output impedance, a plasma matching network with a plasma matching network input impedance, a coupling device connecting the generator and the plasma matching network, the coupling device having a predetermined length, the coupling device and the generator output impedance each having an impedance with a first value, a plasma matching network input impedance with a second value, and wherein the second value is different than the first value by at least 10%.

The present invention also provides a generator matching network with an output impedance having a first value, a plasma matching network with an input impedance having a second value, a coupling device connecting the generator matching network and the plasma matching network, a matching network located on the coupling device between the generator matching network and the plasma matching network, the coupling device having a predetermined length between the matching network and the plasma matching network, the matching network having an impedance with a third value, and wherein the first value and the second value are matched and the third value is different than both the first and second values.

It is therefore an advantage of the present invention to produce a generator and matching networks apparatus which will increase the stability of a plasma.

It is a further advantage of the present invention to produce a generator and matching networks apparatus which will run more stably.

It is a further advantage of the present invention to produce a generator and matching networks apparatus which will run more stably for electronegative gases.

It is a further advantage of the present invention to obtain much better stability in the plasma discharge.

It is a further advantage of the present invention to produce matching networks which allow the plasma to start easier.

It is a further advantage of the present invention to produce matching networks which allow the plasma to start at a lower pressure.

It is a further advantage of the present invention to produce matching networks which decrease the running pressure of a plasma.

It is a further advantage of the present invention to produce matching networks which decrease the starting and running pressure of an inductive plasma.

It is a further advantage of the present invention to provide more stable tunings of the plasma.

It is a further advantage of the present invention that the tuning wells of the plasma will have a greater width and be more stable at a given reflective power.

It is a further advantage of the present invention to not require a change in the plasma tooling.

BRIEF DESCRIPTION OF THE DRAWINGS

FIG. 6(*b*) shows tuning wells for a reflectance power versus capacitor settings for 5.2 mTorr of pressure measured at a second capacitor in a matching network;

FIG. 7(*b*) shows tuning wells for a reflectance power versus capacitor settings for 1 mTorr of pressure measured at a second capacitor in a matching network;

FIG. 8(*b*) shows the tuning wells on a reflectance power versus capacitor settings for 1 mTorr of pressure measured at a second capacitor in a matching network for the "normal case";

DESCRIPTION OF THE PREFERRED EMBODIMENTS

Figure 1:
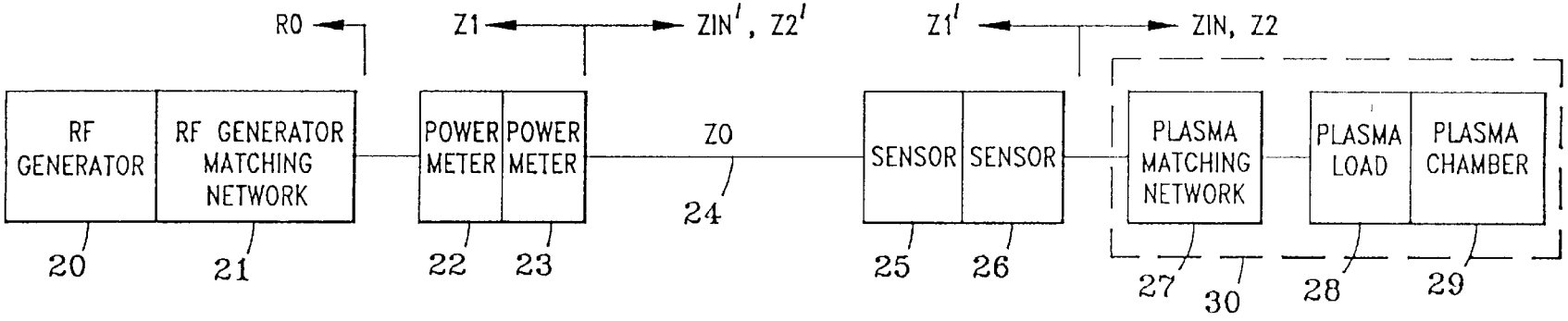
FIG. 1 is a block diagram of a high-frequency supplier in a plasma tool according to a first embodiment.

Although certain preferred embodiments of the present invention will be shown and described in detail, it should be understood that various changes and modifications may be made without departing from the scope of the appended claims. The scope of the present invention will in no way be limited to the sizes of constituting components, the materials thereof, the shapes thereof, the relative arrangement thereof, etc. and are disclosed simply as an example of the embodiment.

An Inductively Couple Plasma (ICP) is a plasma which is driven by an inductive load or antenna. Inductively coupled plasma systems comprise a pair of coils one of which could be an antenna or RF coil and the plasma acts as a secondary of these coupled coils. An inductive load is a reactive load in which the inductive reactance exceeds the capacitive reactance and therefore carries a lagging current with respect to the voltage. Inductively Coupled Plasma systems run at relatively low pressure (1 to 50 mTorr) and the real part of the load increases with power over normal power ranges and the reactive part of the load decreases with power. This can lead to problems in starting the plasma and, particularly for an electronegative gas, can lead to instabilities in the plasma. The problem in starting is due both to their efficiencies being lower at low electron densities and the input power being low which is due to the power being reflected off of the mismatched matching network and plasma load. These two effects also cause or drive the plasma instabilities.

Capacitively coupled plasma systems are designed more traditionally. They contain an electrode that produces an electric field in a plasma which is capacitively coupled through the sheath. The sheath is the boundary of the plasma which normally reduces an electron current to approximately equal an ion current leaving the plasma. In capacitively coupled plasma systems, the real part of the load also increases with increasing power and the capacitive part in some cases decreases.

In both inductively and capacitively coupled plasma systems the actual power and thus the plasma density will vary run to run and within a run due to slight mismatches within the dead band of the match network which causes variations of the power to the plasma. The dead band is a range of values for which an applied control quantity (e.g., current, voltage, phase, or magnitude) has no effect on the response of a circuit. Some plasma systems tune to below a given amount of reflective power and once it is below that power these plasma systems then stop tuning. Once in this region sometimes it takes even more of a mismatch to try and retune them. It has been discovered in accordance with the present invention that a slight mismatch can increase the plasma density and thus increase the power delivered to the plasma. This is most likely due to the generator output impedance having a reactive component to it. One of the problems solved by the present invention is that in electronegative gases, and particularly in RF inductive plasmas in electronegative gases, the plasma can be unstable and the impedance matching can also be unstable. These instabilities worsen as the gas pressure is reduced.

In most plasma tools, the load seen by the matching network is a nonlinear load (i.e., its value changes with power). Therefore, a key feature of most plasma processes is that the plasmas have "nonlinear" impedance characteristics. Non-linearity meaning that the magnitude of the voltage (electric field) in the plasma is not directly proportional to the magnitude of the current (magnetic field). Also, the generators are not ideal generators (i.e., the generators have nonlinear effects of their own).

FIG. 1 discloses the first embodiment of the present invention. FIG. 1 shows RF generator 20, which is used to electrically excite the plasma in a plasma chamber 29, and a generator output matching network 21. FIG. 1 further includes a forward power meter 22 which records the forward power at the output of the generator 20 and a reverse power meter 23 which records the reflected power at the output of the generator 20. The plasma tool 30 includes the plasma chamber 29 with a plasma load 28 and a plasma matching network 27. Power is transmitted to the plasma load 28 through a coupling device such as a transmission line 24 which may be a coaxial cable with an impedance Z0. The inside of the plasma chamber 29 is filled with an electronegative or electropositive gas having a predetermined pressure which will be ignited to form the plasma. RO is the internal resistance of the generator as viewed from the output.

As shown in FIG. 1, the output of the generator has an impedance Z1. Impedance Zin is the input impedance of the plasma matching network 27 and Z2 is the input impedance Zin of the plasma matching network 27 at the operating point of the plasma tool 30. Sensors 25 and 26 are normally, respectively, phase and magnitude sensors operating at impedance Z2 and which read zero when the impedance Zin is equal to Z2. (These sensors could also be forward and reverse power meters).

As the power in the RF generator 20 is reduced from the operating point, the plasma load impedance as seen by the generator Zin' will pass through (or equal in value) at some point the impedance Z1, if Z1 is real, or the complex conjugate of Z1 called Z1*, if the impedance Z1 is complex. Complex impedance meaning that the impedance contains both resistance and reactance components. To describe this another way, as the power in the RF generator 20 is reduced, the input impedance of the plasma matching network Zin becomes equal to the complex conjugate of the output impedance of the generator Z1 transformed by transmission line 24 as seen at the plasma matching network 27 (i.e., output impedance Z1'). If Z0=Z1, then the impedance Z1' is equal to Z1. If Z0≠Z1, then Z1' is the complex conjugate of an impedance which is Z1 transformed by transmission line impedance Z0. Therefore, the desired impedance criteria may be achieved by varying the length of the transmission line 24. The length of the transmission line 24 is set by the operator depending on the type of plasma matching network 27. For instance, this length may be varied by the process engineer depending on the type of plasma matching network 27. Examples of the types of plasma matching networks that may be used include, but are not limited to, the "L", "π", or "T" type. Also, the length of the transmission line 24 may be changed slightly by the operator for different components in a given "type" matching network.

When the plasma matching network input impedance Zin is varied, the maximum power transferred to the plasma load 28 occurs when Zin is equal to Z1, transformed by transmission line impedance Z0, or if Z0=Z1, the maximum power transferred occurs when Zin =Z1. In both of these cases the plasma load impedance as seen by the generator Z1' is equal to the complex conjugate impedance Z1*. Thus any variation either in the plasma load 28 or in the plasma matching network 27 which causes the input impedance of the plasma matching network 27 to vary from impedance Z2 toward impedance Z1' will increase the power to plasma load 28 above that of the operating point. Since impedance Zin is equal to Z1' at some lower RF power and thus a lower plasma density, any variation in the plasma which lowers its density will cause more power to be transmitted to the plasma and thus stabilize the plasma density. Conversely, any plasma variation which increases its density will cause less power to be transmitted.

Figure 2:
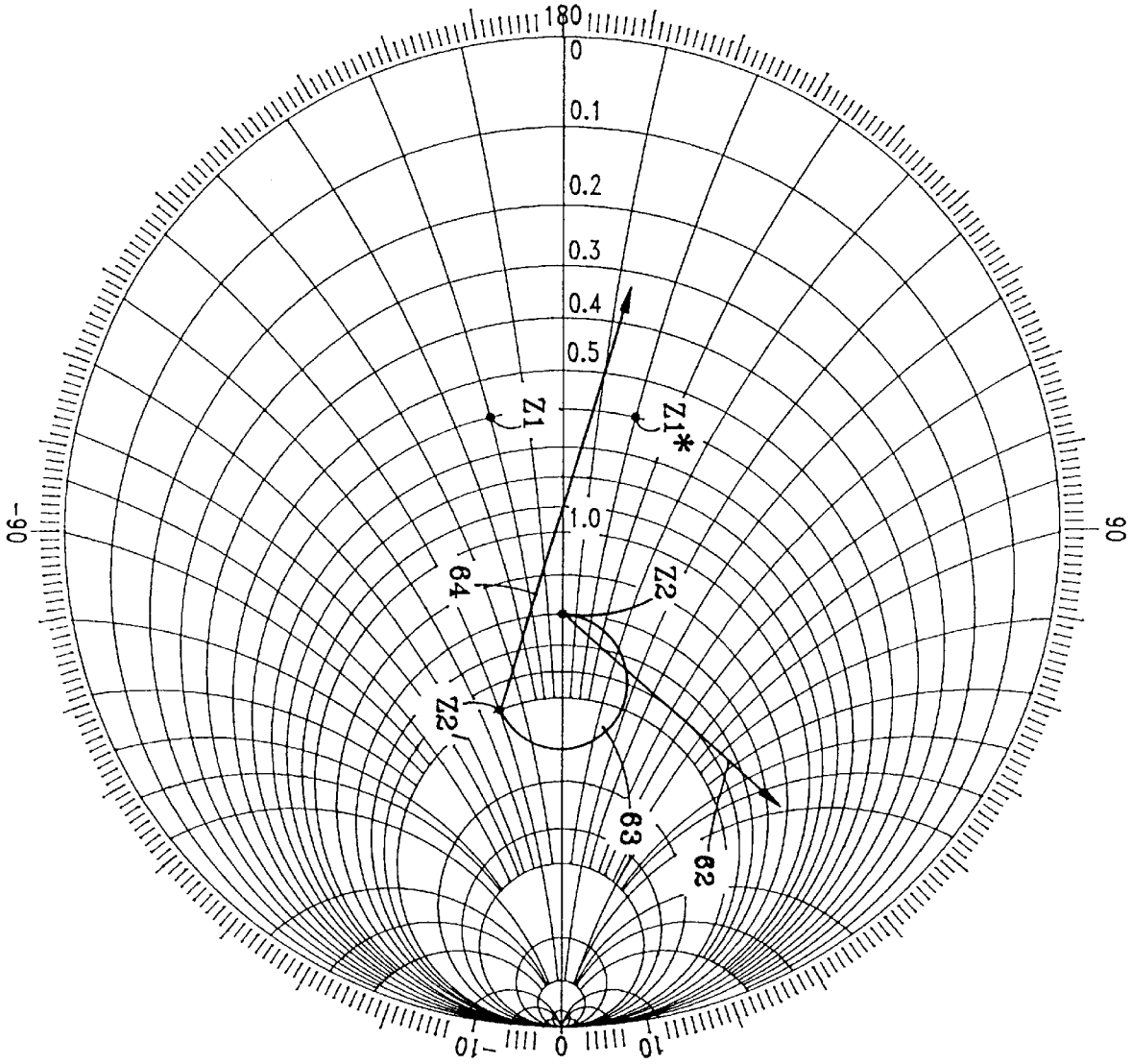
FIG. 2 is a Smith chart which shows the relationship between the impedances of the first embodiment.

FIG. 2 shows an impedance Smith chart with an example of the embodiment shown in FIG. 1. Shown on the Smith chart is the generator output impedance Z1 at 0.6–0.2j (where $j=(-1)^{1/2}$). The complex conjugate of the generator output impedance Z1* is at 0.6+0.2j. Often in RF generators, the reactive part of the generator output impedance Z1 changes as the output power changes. Z2, the input impedance to the plasma matching network 27 at the operating point of the plasma, is shown as being real and having a value of Z2=1.4+0j. The line equal to the impedance Zin, the input impedance of the plasma matching network 27 as the plasma density is reduced, is shown as line 62 on the Smith chart. As shown in FIG. 2, line 62 does not pass near the complex conjugate of the generator output impedance Z1*. Transmission line impedance Z0 is chosen slightly larger than the input impedance to the plasma matching network Z2 in this example for clarity. The transform of impedance Z2 along the length of transmission line 24 toward the generator is shown by line 63 and this impedance at the end of this transmission line is represented by Z2'. Z2' is the input impedance of the load as seen by the RF generator 20. Line 62 is now transformed into line 64, and the length of transmission line 24 has been chosen so that line 64 passes substantially close to impedance Z1*, the complex conjugate of the generator output impedance Z1. Note that line 62 can be transformed into line 64 on the Smith chart by changing the configuration and values in the plasma matching network 27 and/or by changing the length of transmission line 24. Z2 may be more than 10–25% different than Z1 and may go up to as much as 400%. Note that the complex conjugate of the generator output impedance as viewed from the plasma matching network Z1' is the same as the complex conjugate of the output impedance Z1 of the generator 20 transformed by the transmission line 24.

Figure 3:
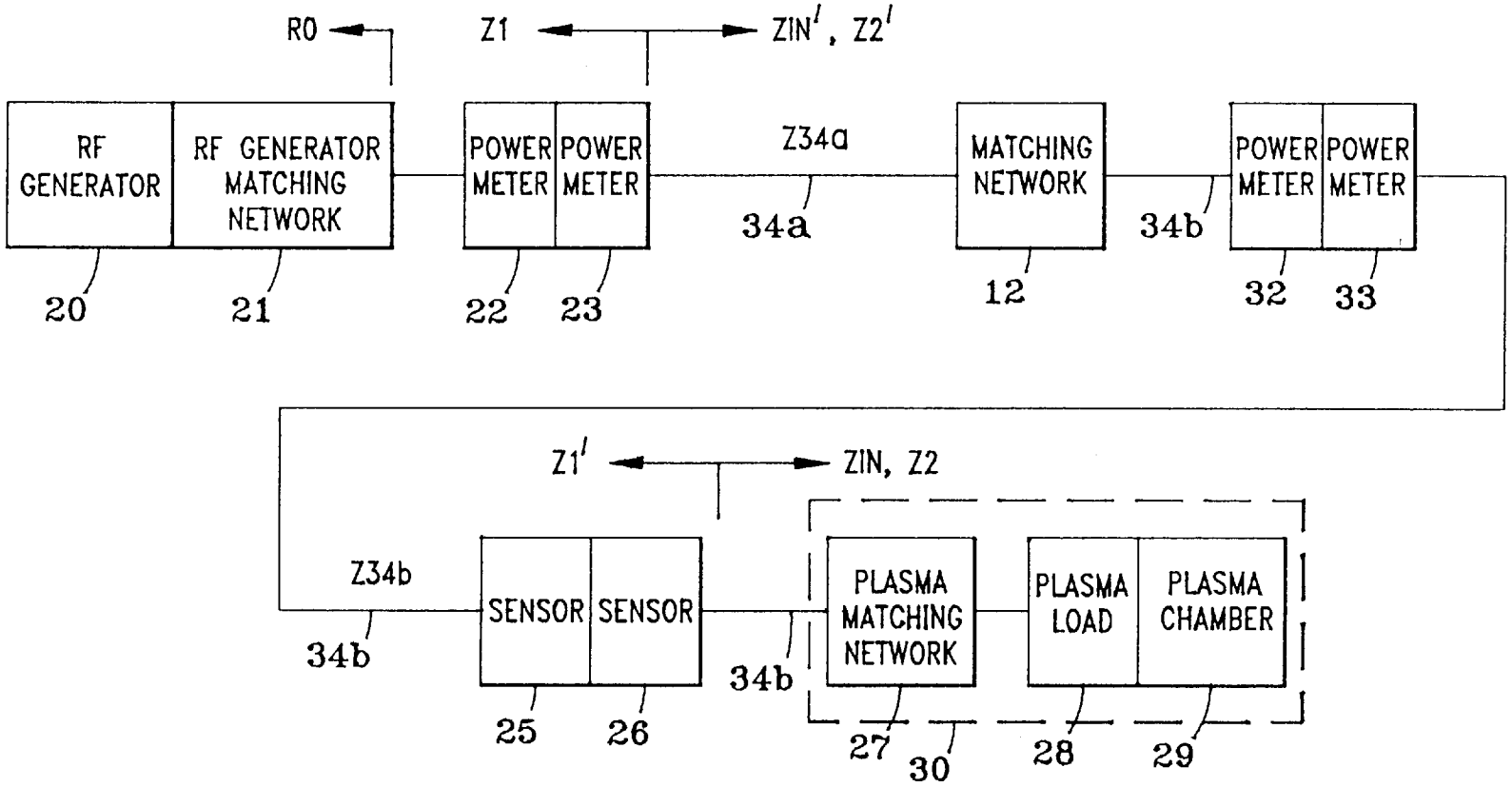
FIG. 3 is a block diagram of a high-frequency supply in a plasma tool according to a second embodiment of the invention.

FIG. 3 shows a second embodiment of the present invention using an additional matching network 12. The plasma matching network 27 is designed to be matched for an impedance which is different from the matching network 12 impedance. The RF generator output matching network impedance Z1 may be nominally 50 ohms and the plasma chamber matching network impedance Z2 may be nominally 50 ohms. The matching network 12 is matched to an impedance which is larger than the output impedance of the generator Z1, or the internal resistance of the generator, as seen by the matching network 12. (For example, the matching network 12 can be matched to an impedance in the range of 75 to 110 ohms with the best results achieved at 110 ohms). Transmission line 34*a* connects the RF generator matching network 21 to matching network 12 and transmission line 34*b* connects matching network 12 to plasma matching network 27. The impedance of 34*a* is Z34*a* and the impedance of 34*b* is Z34*b*. The impedance of each of these transmission lines may be nominally 50 ohms. Transmission line 34*b* may have forward power meter 32 and reflected power meter 33 for reading the forward and reflected power on the transmission line 34*b*. If Z34*a* and Z2 are both 50 ohms then reflected power meter 33 will read zero at the operating point, while transmission line 34*a* will have reflected power on it. The length of transmission line 34*a* will be set by the operator such that as the power in the RF generator 20 is reduced or the plasma density in the plasma chamber 29 is decreased, the value of impedance Zin will pass substantially close to Z1', the complex conjugate of the generator output impedance Z1 as seen at plasma matching network 27. Thus, as the plasma density increases the power supplied will decrease to bring the plasma density back to the desired operating point. Likewise if the plasma density decreases, the transfer power to the plasma will increase to again bring the plasma back to the desired operating point. Thus the plasma stability will have been increased.

Figure 4:
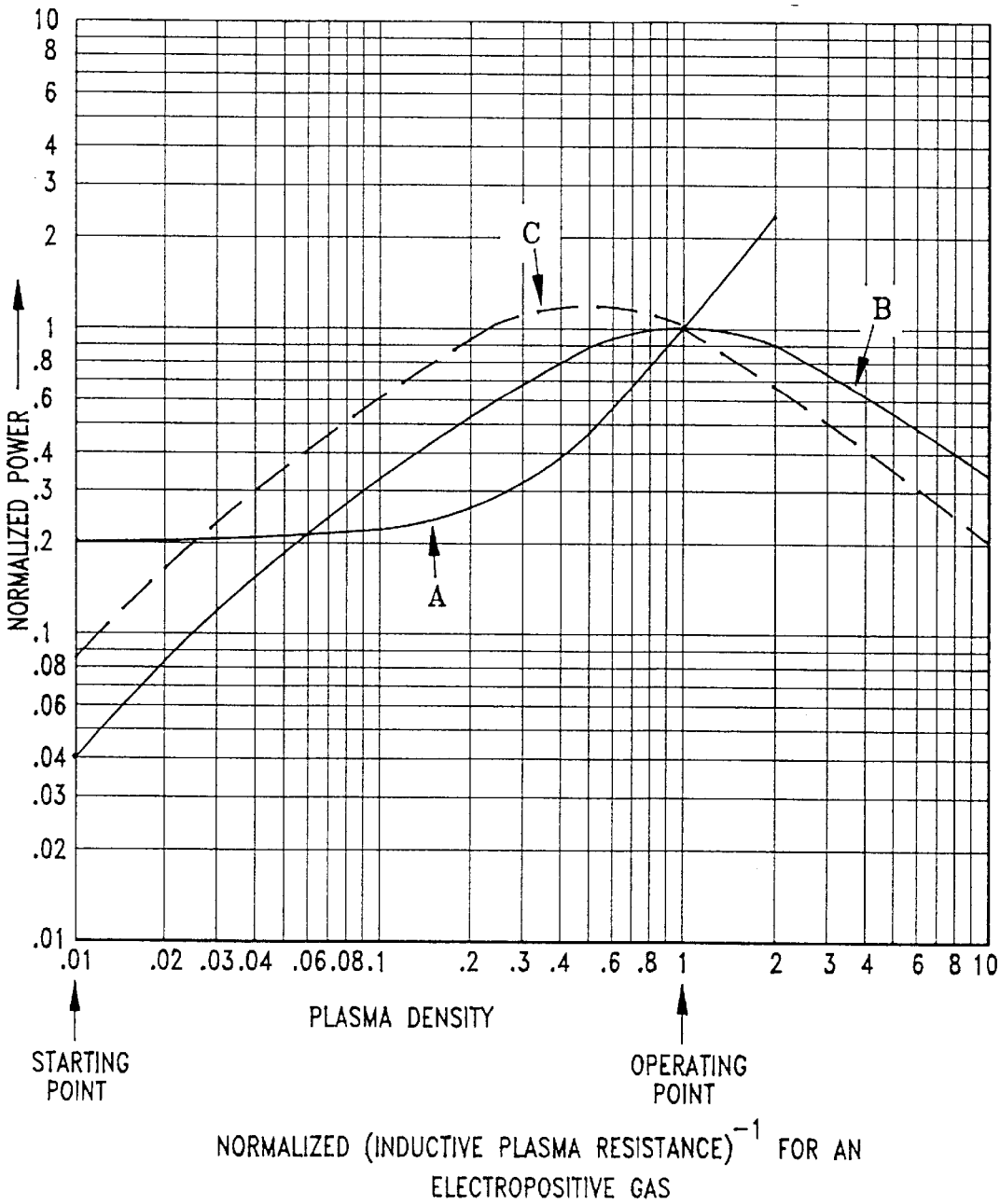
FIG. 4 is a chart showing the required and delivered power for a purely inductive plasma versus the plasma resistance for an electropositive gas.
Figure 5:
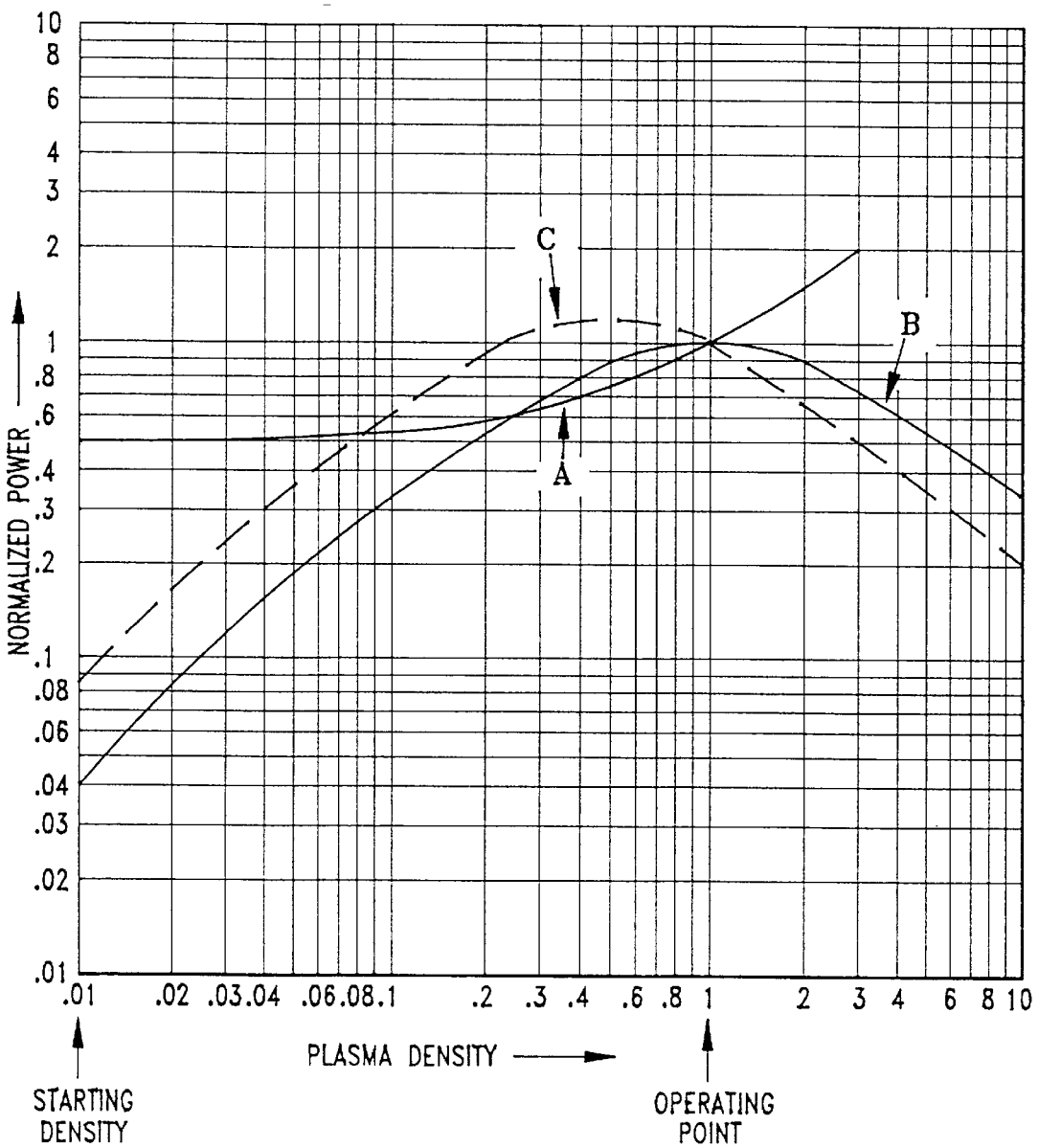
FIG. 5 is a chart showing the required and delivered power for a purely inductive plasma versus the plasma resistance for an electronegative gas.

For the starting conditions, when the plasma density produced by the capacitive coupling between the RF coil and the plasma is very low the transfer power will be greater for the present invention than for the "normal case" where the plasma matching network 27 is matched to the generator impedance Z1. This is due to the fact that in the present invention the reflected power will be less. Indeed the transferred power at the starting conditions can be made equal to or even greater than the power transferred at the operating point. This is shown in FIGS. 4 and 5 where the present invention would be matched for a plasma density of roughly ½ that of the operating point (i.e., the plasma load resistance is twice as large). For an Advanced Energy RF generator this mismatch is only ½ of the specification of reflected power for maintaining regulation. FIG. 4 is a chart showing the delivered power and the required power for a purely inductive plasma versus the plasma load resistance for an electropositive gas. Line A represents the power required by an inductive plasma for an electropositive gas. Line B is the "normal case" delivered power without the mismatching. Line C represents the present invention delivered power. In this example, both the "normal case" (where the matching network 12 is matched to the same value as the generator matching network 21 and the plasma matching network 27) and the present invention (where the matching network 12 is unmatched with the generator matching network 21 and the plasma matching network 27) are stable, but the present invention has the advantage of giving 2.2 times the power at the starting density. FIG. 5 is a chart of the delivered power and the required power for a purely inductive plasma versus the plasma load resistance for an electronegative gas. Line A represents the power required by an inductive plasma for an electronegative gas. Line B is the "normal case" delivered power without the present invention. Line C represents the delivered power with the present invention. For an electronegative gas the electron density is lower and thus the power efficiency is lower. In FIG. 5, for the "normal case" the plasma is only marginally stable so that any plasma oscillations can cause the plasma density to oscillate or even go out. However, for the present invention the plasma is still stable and again the starting power is 2.2 times the "normal case." In both cases, the capacitive coupling will increase the starting power but not the operating power.

It should be noted that another improvement of the present invention is that it gives much better stability to the plasma discharge and also decreases the starting and running pressure of a plasma, especially an inductive plasma.

It is also true that the present invention makes the tuning wells wider which is an indication of stability of the plasma. Tuning wells are obtained by measuring the reflective power versus the variation in component values in the matching network 12 which produces a curve which goes through zero reflected power. Any variation of the tuning elements in the plasma matching network 27 from operating point will cause less reflected power for this embodiment than for the case when Z2=Z1'. This is discussed further in reference to FIGS. 6(*a*)–8(*b*).

Figure 6B:
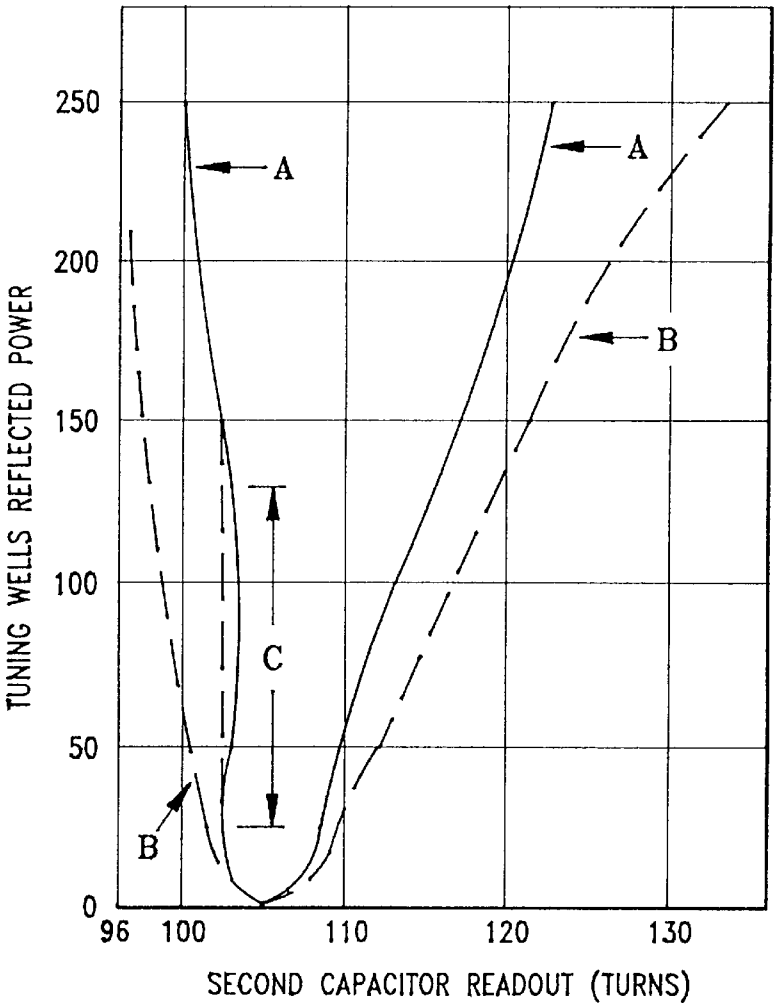
FIG. 6(*a*) shows tuning wells for a reflectance power versus capacitor settings for 5.2 mTorr of pressure measured at a first capacitor in a matching network.
Figure 6A:
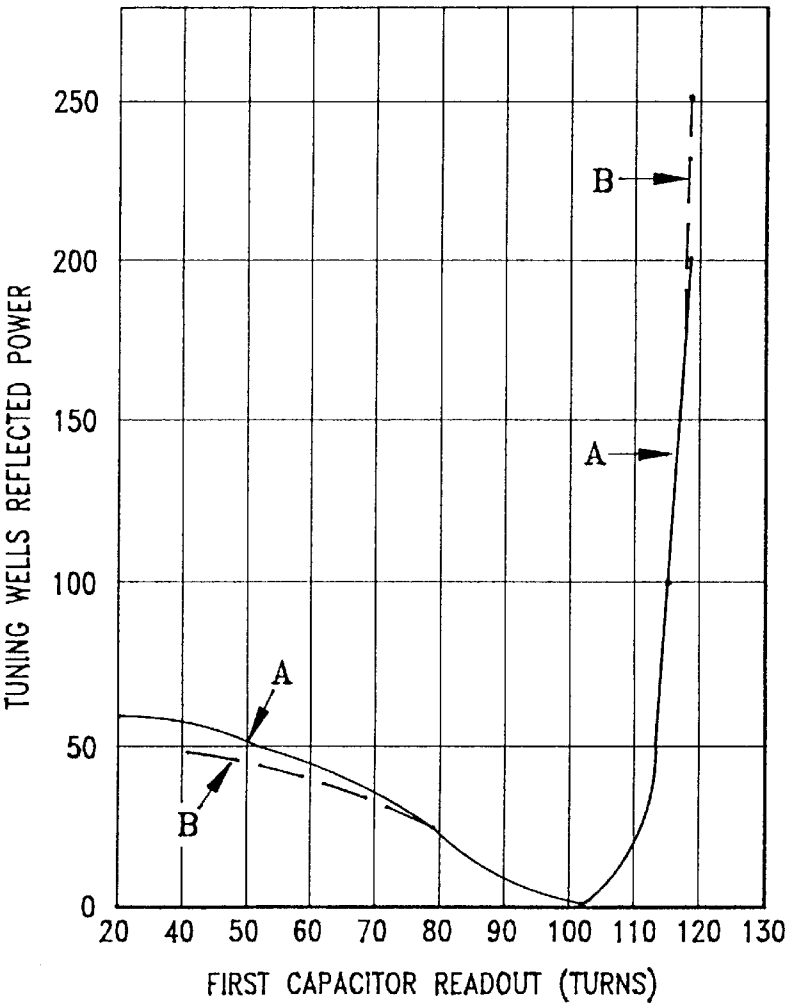
Figure 7B:
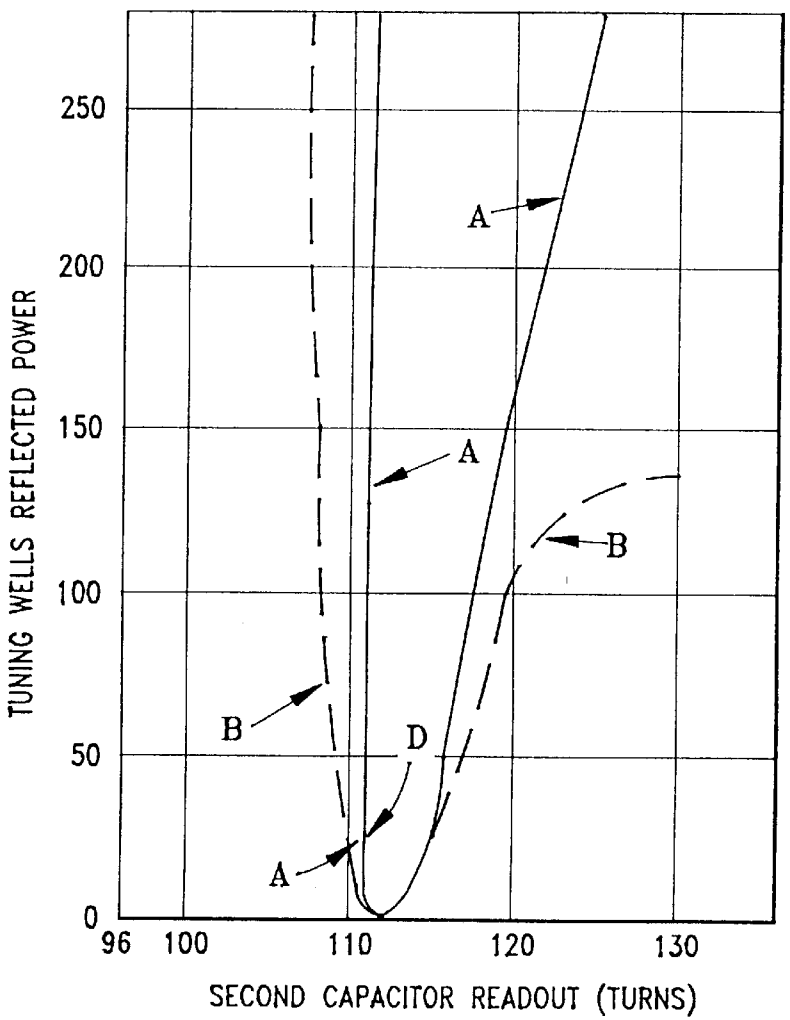
FIG. 7(*a*) shows tuning wells for a reflectance power versus capacitor settings for 1 mTorr of pressure measured at a first capacitor in a matching network.
Figure 7A:
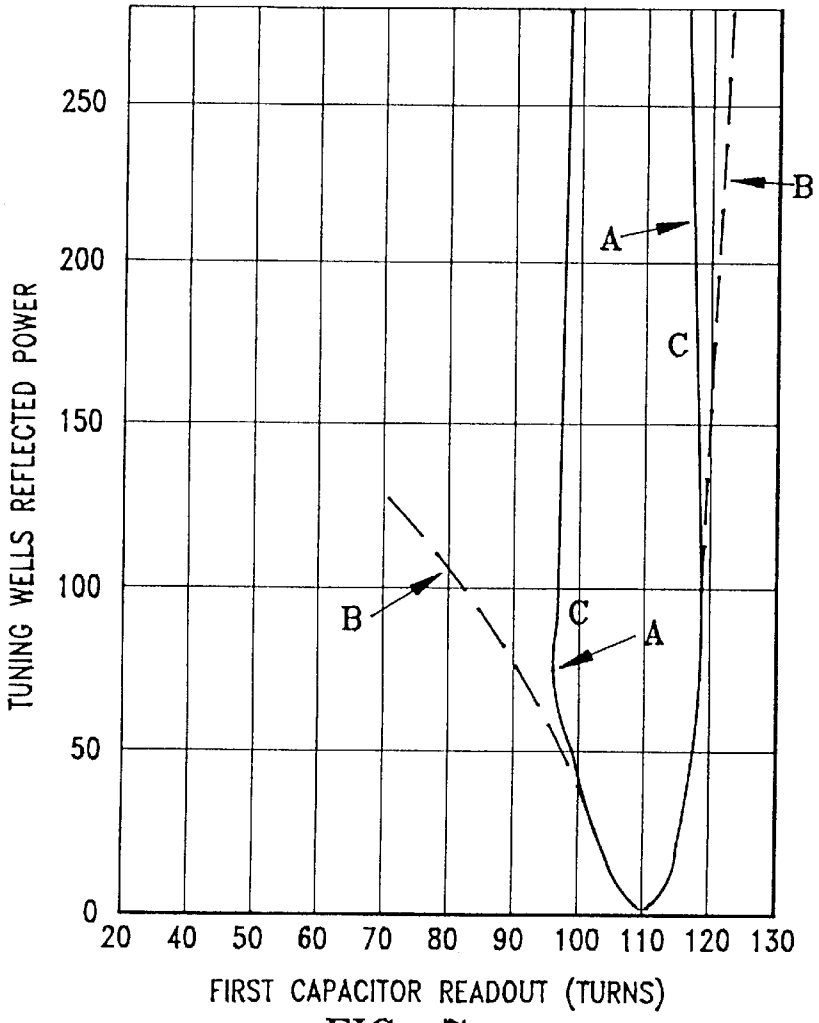
Figure 8B:
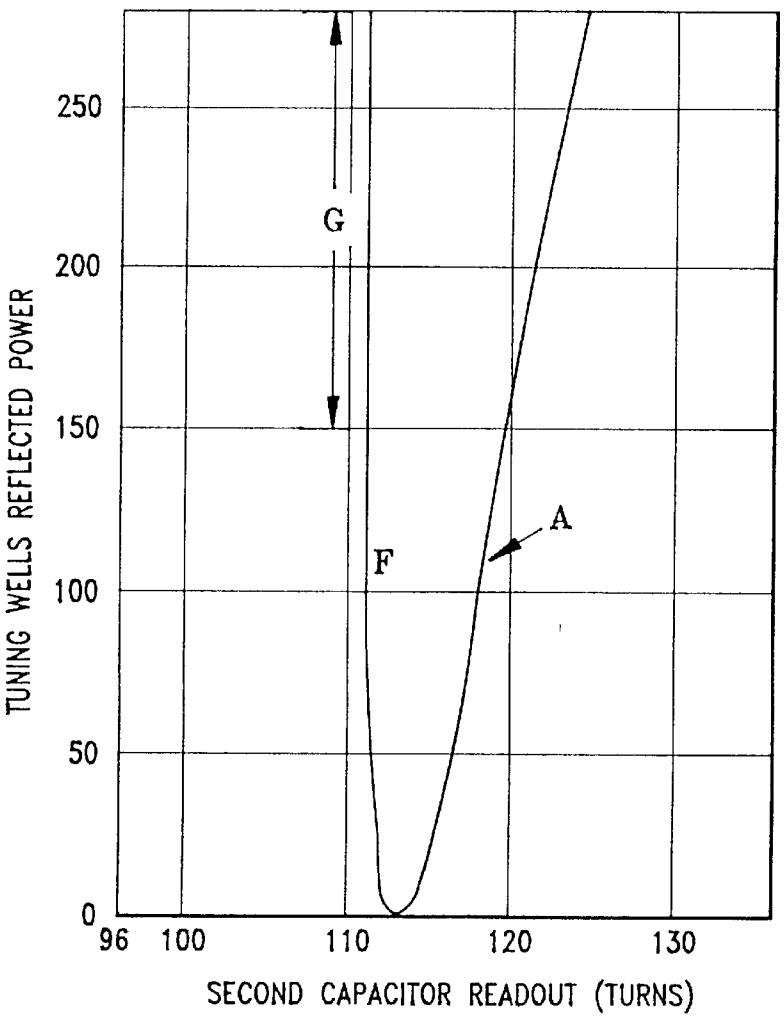
FIG. 8(*a*) shows the tuning wells on a reflectance power versus capacitor settings for 1 mTorr of pressure measured at a first capacitor in a matching network for the "normal case"
Figure 8A:
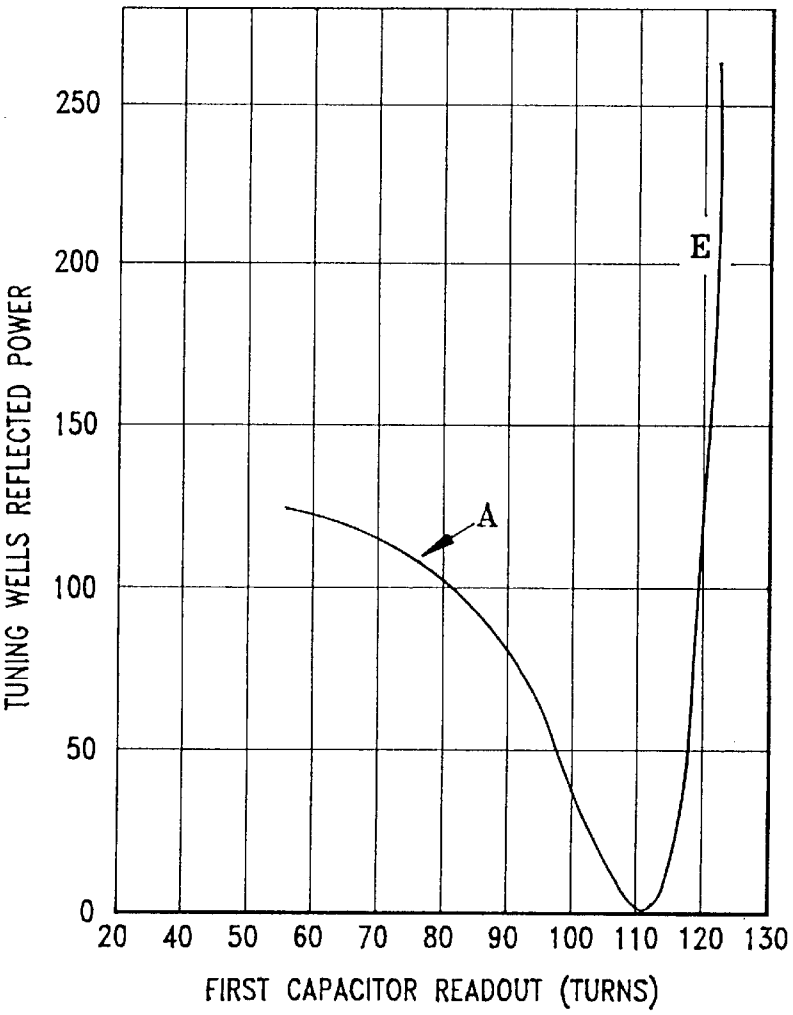

FIG. 6(*a*) shows tuning wells for a reflectance power versus capacitor settings for a relatively stable pressure of 5.2 mTorr of pressure measured at a first capacitor in the matching network 12. FIG. 6(*b*) shows tuning wells for a reflectance power versus capacitor settings for the second capacitor in the matching network 12. Note that the plasma matching network 27 used in this example to obtain the measurements was a "T" type with a first capacitor at the input branch of the "T" circuit and a second capacitor at the output branch of the "T" circuit. (As previously stated, the matching network could also be an "L" or "π" type). The capacitance is not measured in units, but rather in "turns" and shown in the figures as tenths of turns. In FIGS. 6(*a*) and 6(*b*), line A represents the "normal case" with the matching network 12 being set to 50 ohms and line B represents the case of the present invention with the matching network being set to an unmatched 85 ohms. The 50 ohm case shows a small jump in FIG. 6(*b*) at C. The 85 ohm case shows completely stable operation up to 250 watts reflected. FIG. 7(*a*) shows tuning wells for a reflectance power versus capacitor settings for 1 mTorr of pressure measured at a first capacitor in a matching network 12. FIG. 7(*b*) shows a tuning wells for a reflectance power versus capacitor settings for 1 mTorr of pressure measured at a second capacitor in a matching network 12. In FIGS. 7(*a*) and 7(*b*), line A represents the "normal case" with the matching network 12 being set to 50 ohms, line B represents the case of the present invention with the matching network being set to an unmatched 85 ohms, and C represents points in the line where the plasma goes out. For the 50 ohm case the plasma goes out at only 27 watts reflected (shown at point D in FIG. 7(*b*)). While for the 85 ohm case it is stable to greater than 250 watts reflected. FIG. 8(*a*) shows tuning wells on a reflecting power versus capacitor settings for 1 mTorr of pressure measured at a first capacitor in a matching network for a "normal case." FIG. 8(*b*) shows tuning wells on a reflecting power versus capacitor settings for 1 mTorr of pressure measured at a second capacitor in a matching network for a "normal case." In FIGS. 8(*a*) and 8(*b*), line A represents the "normal case" with the matching network 12 being set to 50 ohms. FIG. 8(*a*) shows the best tuning wells being varied for a pressure of 1 mTorr and a 50 ohm matched network by varying the length of the transmission line located between the generator and the matching network. Point E shows the plasma turn off point. FIG. 8(*b*) shows the optimum case for a pressure of 1 mTorr and a 50 ohm matched network and the plasma still turns off at 100 watts (point F). G shows the reflected power jump. Therefore, the current invention has significant advantages over the "normal case" networks.

Figure 9:
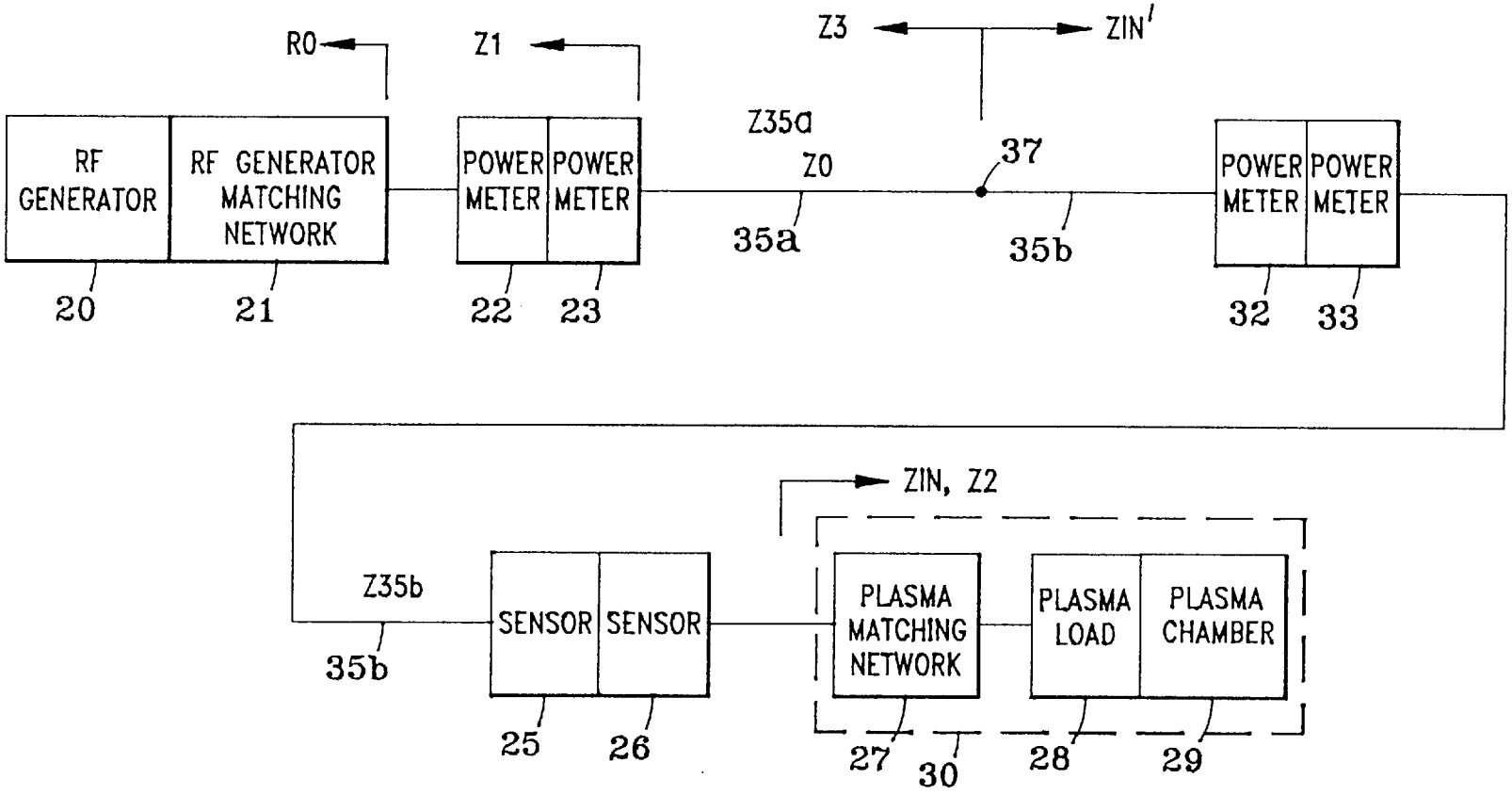
FIG. 9 is a diagram of a high frequency supplier in a plasma tool according to a third embodiment of the invention.

FIG. 9 shows a third embodiment of the present invention which has power generated through two transmission lines with unmatched impedances which are connected at connecting point 37. In FIG. 9, the generator output impedance Z1 may be set nominally at 50 ohms. Power is transmitted through the two different transmission lines 35*a* and 35*b*. Transmission line 35*a* has an impedance Z35*a* which is different from Z1. Transmission line 35*b* will have an impedance Z35*b* which is different from Z35*a* and the same as Z1. Therefore, when Z1 is nominally set at 50 ohms, the value of Z35*a* would be something different such as 75 ohms and the value of Z35*b* would be 50 ohms. Transmission line 35*a* will thus transform impedance Z1 to some other impedance Z3 at the connection point 37 on the transmission line. In the case where Z1=50 ohms and Z35*a*=75 ohms and the electrical length of transmission line 35*a* is equal to ¼ wave length then:

$$Z3=(75)^2/50=112.5 \text{ ohms}$$

Sensors 25 and 26 are normally phase and magnitude sensors operating at impedance Z2. Sensors 25 and 26 are used for matching the plasma matching network input impedance Zin to an impedance Z2 (also nominally 50 ohms at the operating point). Sensors 25 and 26 operating at Z2 would read zero and thus signal when the input impedance Zin of the plasma matching network 27 is equal to Z2. These sensors could also be forward and reverse power meters operating at Z2. If sensors 25 and 26 are not power meters, power meters 32 and 33 may also be used near sensors 25 and 26.

The length of transmission line 35*b* should be such that the input impedance Zin of plasma matching network 27 is transformed to an impedance Zin' which is different than the complex conjugate of Z3, here denoted as Z3* at the operating point of the plasma, but such that as the plasma density of plasma chamber 29 is decreased passes substantially close to Z3*. Also, the length of transmission line 35*b* may be zero if the impedance transform of the plasma matching network 27 and the transform of transmission line 35*a* are such that as the plasma density in plasma chamber 29 is reduced the impedance Zin' passes substantially close to Z3*.

Figure 10:
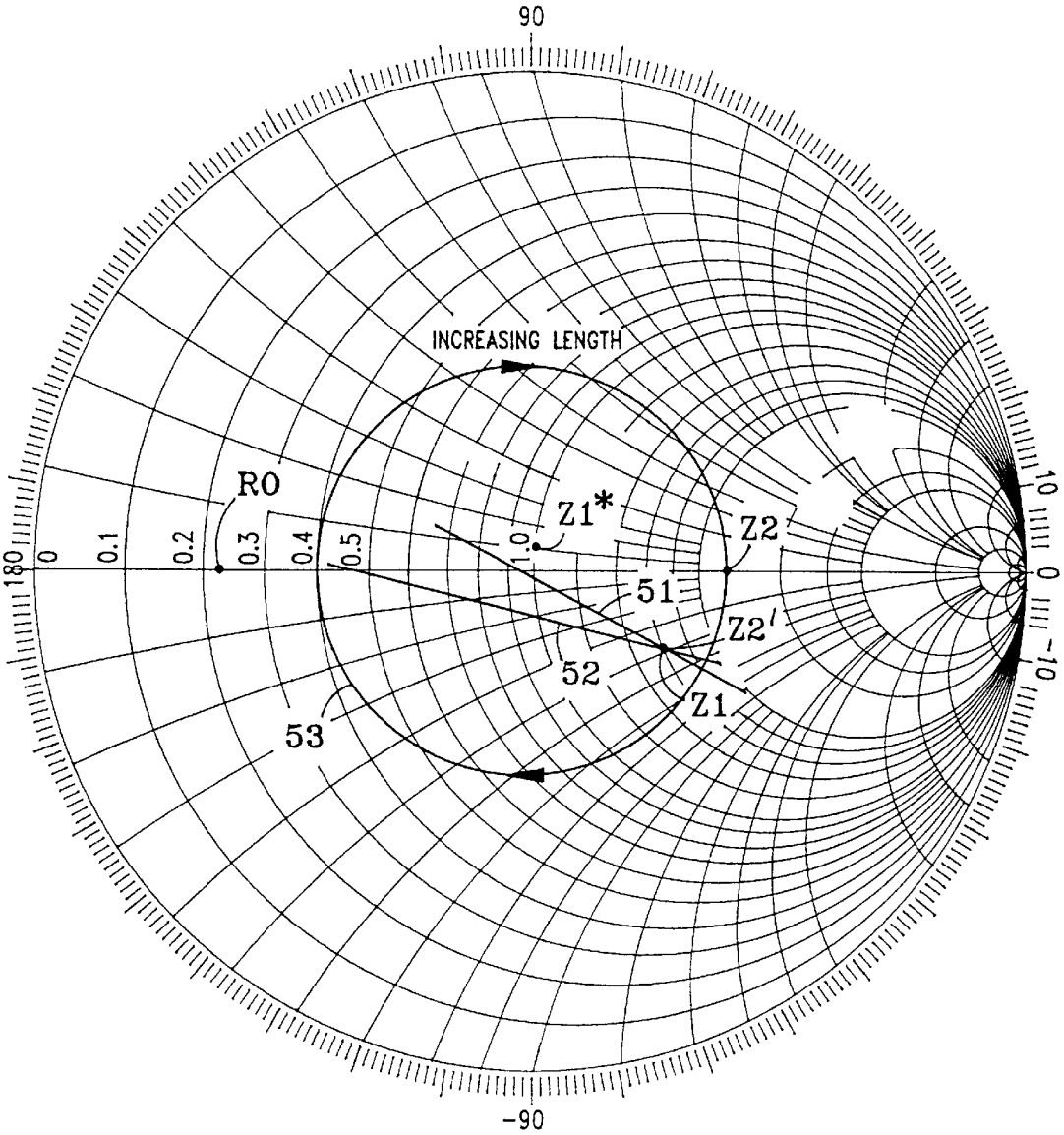
FIG. 10 is a Smith chart showing the relationship among the impedances of the third embodiment.

Referring now to the Smith chart in FIG. 10, impedance Z2, which is the input impedance of plasma matching network 27 as seen by the RF generator 20, is some impedance which is different than Z1 or Z1* the complex conjugate of the output impedance of the generator 20. Line 51 is the locus of the impedance variations caused by the slow instability and such that at some sufficient reduction in plasma density caused by this slower instability will pass substantially close to the impedance Z1*. Also shown is line 52 which is the impedance variation caused by the faster instability. Z2' should be in such a position so that for sufficient reduction in plasma density caused by said faster instability line 52 will pass between Z1* and R0. For reference also shown in FIG. 10 are all the possible locations 53 of Z2' for a given Z2 produced by a coax cable of varying lengths and impedance Z2. If lines 51 and 52 lie very close to each other then Z2' should have a magnitude greater than Z1* and should be mostly real.

Any Z2' which produces the same reflection coefficient such that when the plasma density decreases Zin' passes through Z1* will produce the same stability and running pressure capability. However, it is also possible to have the impedance Z2' be larger than Z1*, and nearly real, since this will make the RF generator more efficient at the operating point. This could allow operation of the RF generator at larger reflection coefficients and thus even larger stability and low pressure capability.

Some researchers have found that in low pressure inductive plasmas in electronegative gases there are two instabilities. One of these instabilities is faster than the other, i.e. its oscillation frequency is higher and the impedance variations in plasma impedance 28 may be in slightly different directions. In this case as the preferred embodiment of this invention would have the load impedance as seen by the generator Zin' pass substantially close to Z1* at some sufficient reduction in plasma density caused by this slower instability. For some sufficient reduction in plasma density caused by said faster instability, this load impedance at the generator will pass substantially close to an impedance which is between R0 and Z1*.

Figure 11:
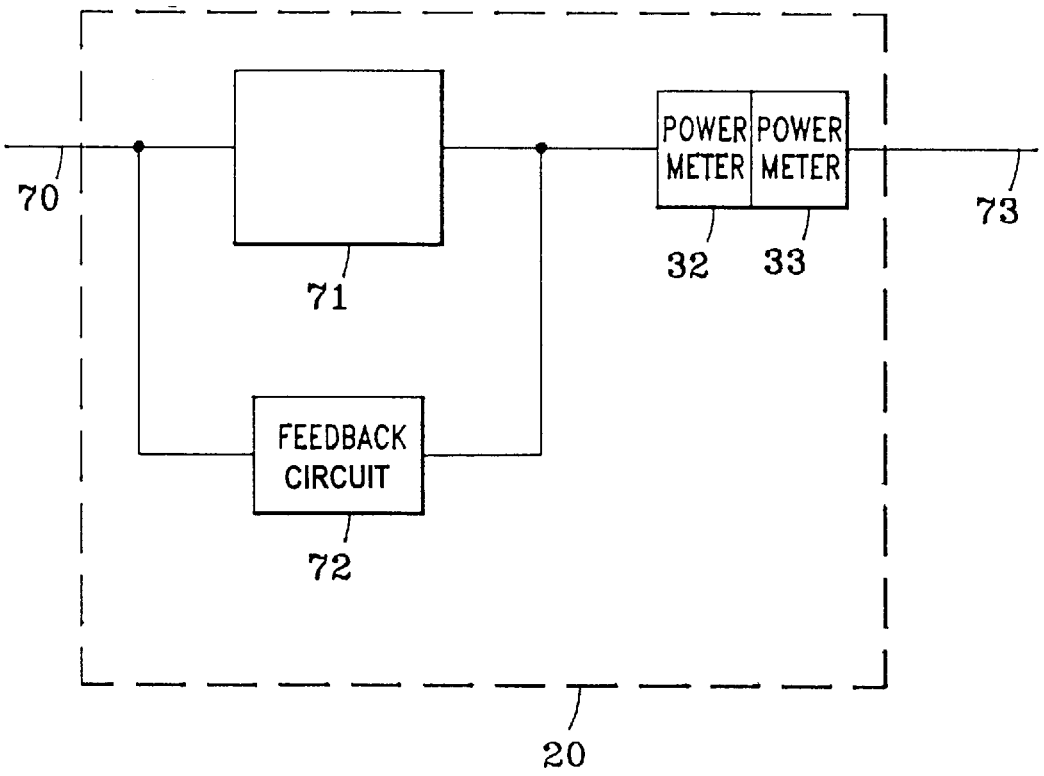
FIG. 11 shows a feedback circuit which may be used to regulate the generator.

Referring to a fourth embodiment shown in FIG. 11, input 70 controls the desired output power level into a 50 ohm load. Further shown is RF electronics 71 with an internal resistance RO less than 50 ohms and nominally about 12.5 ohms. Feedback loop 72 can monitor either output current or output power. In the "normal case" this feedback loop made the output impedance equal to 50 ohms and the forward power constant at the desired input level as the load varied over a certain range from 50 ohms. In this embodiment, feedback loop 72 would have a different gain such that the output impedance is different than 50 ohms and such that the forward power is not fixed as the load changes. The difference from 50 ohms should be such that a 50 ohm load would produce a power reflection coefficient of 0.04 or greater. Power meters 32 and 33 would measure the forward and reflected power for a 50 ohm transmission line.

According to this fourth embodiment, the matching networks 21 and 12 of FIG. 3 may be combined, eliminating transmission line 34*a*, and power meters 22 and 23. Thus, matching networks 21 and 12 and meters 32 and 33 can all be packaged in the RF generator. Then with the transmission line 73 at a predetermined length, such that as the generator power decreases or as the plasma density decreases Zin passes substantially close to Z1' this generator will have the added features of greater plasma stability, wider tuning wells for the tuning of the plasma matching network 27, and lower running and starting pressure of the plasma. Therefore, the reflected power meter will read zero at the operating point of Z2. Only the internal feed back circuit 72 needs to be changed since the internal resistance of the generator can be constant; thereby the output impedance Z1 is significantly different from 50 ohms such that a 50 ohms load would produce a power reflection coefficient greater than 0.04 or a voltage reflection coefficient of 0.2.

We claim:

1. A plasma apparatus comprising:

a generator with a generator output impedance;

a plasma matching network with a plasma matching network input impedance;

a coupling device connecting the generator and the plasma matching network;

said coupling device having a predetermined length;

said coupling device and said generator having an output impedance with a first value;

a plasma matching network input impedance with a second value; and wherein the second value is different than the first value by an amount of at least 10%.

2. The plasma apparatus of claim 1, wherein the second value is different than the first value by an amount in the range of 10–25%.

3. The plasma apparatus of claim 1, wherein the second value is different than the first value by an amount up to 200%.

4. The plasma apparatus of claim 1, where in the second value is different than the first value by an amount up to 400%.

5. The plasma apparatus of claim 1, wherein the predetermined length of the coupling device will vary depending on the type of plasma matching network.

6. The plasma apparatus of claim 5, wherein the predetermined length of the coupling device will vary depending on the components in the plasma matching network.

7. A plasma apparatus comprising:

a generator matching network with an output impedance having a first value;

a plasma matching network with an input impedance having a second value;

a coupling device connecting the generator matching network and the plasma matching network;

a matching network located on the coupling device between the generator matching network and the plasma matching network;

said coupling device having a predetermined length between the matching network and the plasma matching network;

said matching network having an impedance with a third value; and wherein the first value and the second value are matched and the third value is different than both the first and second values.

8. The plasma apparatus of claim 7, wherein the first value and second value are each 50 ohms and the third value is 85 ohms.

9. The plasma apparatus of claim 7, wherein the first value and second value are each 50 ohms and the third value is 110 ohms.

10. The plasma apparatus of claim 7, wherein the coupling device is a transmission line.

11. A plasma apparatus comprising:

a generator matching network with a generator output impedance with a first value;

a plasma matching network;

a first coupling device connecting the generator to a second coupling device and the second coupling device connecting the first coupling device to the plasma matching network;

the first coupling device having an impedance with a second value;

the second coupling device having an impedance with a third value; and wherein the first and third values are substantially the same and the second value is different from both of the first and third values.

12. The plasma apparatus of claim 11, wherein the first and third values are substantially equal to 50 ohms and the second value is substantially equal to 75 ohms.

13. A plasma apparatus comprising:

a plasma chamber containing a plasma with a predetermined density at a predetermined operating point;

a plasma matching network;

a generator with a predetermined RF power;

a coupling device having a predetermined length connecting the generator matching network to the plasma matching network;

a coupling device input impedance with a first value;

a generator output impedance with a second value;

wherein the first value and second value are different when the plasma is at the predetermined operating point; and the first value and second value substantially match when either the plasma density decreases or the RF power in said generator decreases.

14. The plasma apparatus of claim 13, wherein the coupling device is a transmission line.

15. The plasma apparatus of claim 13, wherein the coupling device is a coaxial cable.

16. The plasma apparatus of claim 13, wherein the plasma apparatus contains a discharge gas which is an electronegative gas.

17. The plasma apparatus of claim 13, wherein the plasma is an inductively coupled plasma.

18. The plasma apparatus of claim 13, wherein the complex conjugate of the first value will substantially match to the second value when either the plasma density decreases or the RF power in said generator decreases.

19. A plasma apparatus comprising:

a plasma chamber containing a plasma with a predetermined density;

a plasma matching network;

a generator with a predetermined power;

a coupling device having a predetermined length connecting the generator to the plasma matching network;

a plasma matching network input impedance with a first value;

a generator output impedance and a coupling device impedance with a second value;

wherein the first value and the second value are different when the plasma is at the operating point; and the first value and second value substantially match when the plasma density decreases or the power of the generator decreases.

20. The plasma apparatus of claim 19, wherein the coupling device is a coaxial cable.

21. The plasma apparatus of claim 19, wherein the plasma apparatus contains an electronegative gas.

22. The plasma apparatus of claim 19, wherein the plasma apparatus contains an electropositive gas.

23. The plasma apparatus of claim 19, wherein the plasma is an inductively coupled plasma.

24. The plasma apparatus of claim 19, wherein the plasma matching network input impedance will substantially match to the complex conjugate of the second value at the point in time when the plasma density decreases.

25. A method of stabilizing a plasma with a predetermined density in a plasma tool comprising:

setting a predetermined length on a coupling device and a predetermined length on a second coupling device;

running the plasma tool with the impedance of the first coupling device and a generator output impedance unmatched when the plasma with a predetermined density is at a predetermined operating point; and running the plasma tool with the impedance of the first coupling device and the generator output impedance substantially matched when the density of the plasma is decreasing.

26. The method of claim 25, wherein the complex impedance of the first coupling device impedance will substantially match to the complex conjugate of the output impedance when the density of the plasma is decreasing.

27. An RF generator apparatus for driving a nonlinear load comprising:

a feedback circuit to monitor generator output current or power;

a forward and reflected power measuring device for a 50ohm transmission line;

an RF internal resistance with a first value; and a generator output impedance with a second value;

wherein the second value is substantially different than either the first value or 50 ohms, and the power reflection coefficient is greater than 0.04 for the second value and a load impedance of 50 ohms.

28. The RF generator apparatus of claim 27, wherein the first value is less than 50 ohms.

29. The RF generator apparatus of claim 27, wherein the first value is substantially equal to 12.5 ohms.

30. A method for stabilizing a plasma with a predetermined density in a plasma tool comprising:

setting a predetermined length on a coupling device, and running the plasma tool with a substantially matching plasma network input impedance which is substantially matched to the input of its sensors, and unmatched to the generator output impedance, while the plasma is at a predetermined operating point, whereby the input impedance, and the generator output impedance are substantially matched when the density of the plasma is decreased.

31. The method of claim 30, wherein the plasma matching network input impedance will substantially match to the complex conjugate of the output impedance when the density of the plasma is decreasing.

32. The method of claim 30, wherein the coupling device is a transmission line.

33. The method of claim 30, wherein the coupling device is a coaxial cable.

34. The method of claim 30, wherein the plasma is an inductively coupled plasma.

35. The method of claim 30, wherein the plasma apparatus contains a discharge gas which is an electronegative gas.

36. A method of stabilizing a plasma with a predetermined density in a plasma tool comprising:

setting a predetermined length on a coupling device;

running the plasma tool with a matching network input impedance and a generator output impedance unmatched when the plasma with a predetermined density is at a predetermined operating point; and running the plasma tools with the matching network impedance and the generator output impedance substantially matched when the density of the plasma is decreasing and the input impedance being substantially matched to the generator output impedance.

37. The method of claim 36, wherein the complex matching network impedance will substantially match to the complex conjugate of the output impedance when the density of the plasma is decreasing.

38. An RF generator apparatus for driving a nonlinear load comprising:

an RF generator having an output impedance value not equal to 50 ohms;

a first and second power measuring device which can measure forward and reflected power on a 50 ohm transmission line and show essentially zero reflected power when a non-linear load has a value of 50;

where the output impedance value of the RF generator is sufficiently different from 50 ohms, to produce a power reflection coefficient of greater than 0.04 when the nonlinear load has a value of 50 ohms.

* * * * *